United States Patent [19]

Ravencroft

[11] Patent Number: 4,671,493

[45] Date of Patent: Jun. 9, 1987

[54] STAKE PULLER FOR CONCRETE FORM STAKES

[76] Inventor: Gary N. Ravencroft, 5011 Ravelle Ct., Paradise, Calif. 95969

[21] Appl. No.: 832,380

[22] Filed: Feb. 24, 1986

[51] Int. Cl.[4] ..... B66F 3/00

[52] U.S. Cl. ..... 254/131

[58] Field of Search ..... 254/131, 132

[56] References Cited

U.S. PATENT DOCUMENTS

| | | | |
|---|---|---|---|
| 331,054 | 11/1885 | Heard | 254/132 |
| 458,696 | 9/1891 | Shoemake | 254/132 |
| 658,613 | 9/1900 | Beronio | 254/131 |
| 3,586,292 | 2/1969 | Buck | 254/131 |
| 3,852,839 | 12/1974 | Blessing | 254/131 |
| 4,573,339 | 3/1986 | Emery | 254/131 |

FOREIGN PATENT DOCUMENTS

| | | | |
|---|---|---|---|
| 804426 | 4/1951 | Fed. Rep. of Germany | 254/131 |

*Primary Examiner*—Frederick R. Schmidt
*Assistant Examiner*—Judy J. Hartman

[57] ABSTRACT

A stake puller for concrete form stakes both wooden and metal is structured to use the form top as a levering platform. A U-shaped levering head is affixed with angled form grippers at both ends of the opend U. The closed end of the U has a levering arm attached and a pliable protective cover fits over the handle. A sectional scissor structure with each section axially pinned together and having a small control handle centrally fitted is suspended in the U-shaped levering head by a hinge and hanger plate. The two lower sectional leg bars have the tip ends angled outward to form stake gripper toes as a means for grabbing onto and pulling a stake. A depth control blockage is affixed to the underside of the grippers to prevent stake bite-through.

3 Claims, 5 Drawing Figures

STAKE PULLER FOR CONCRETE FORM STAKES

BACKGROUND OF THE INVENTION

This invention relates to levering tools useful for the pulling of concrete form stakes both wooden and metal from hardening concrete to facilitate the removal of the forms. The present invention is particularly directed towards devices using the top of the form as a levering platform.

As the tool described in the following specification appears to have unique mechanics, patents disclosing levering devices seen were of an entirely different nature from the present invention. Of several V-shaped pullers discovered, no devices seen would be similar in design or purpose to the present invention.

OBJECTS OF THE INVENTION

Therefore, it is a principal object of this invention to provide a levering tool for pulling concrete form stakes both metal and wood from hardening concrete for removal of the forming materials supporting concrete foundations and walls.

A further object of the invention is to provide a concrete form stake puller adjustable to fit all sizes of forming stakes.

A still further object of the present invention is to provide a stake puller designed for levering against the top of the form with sufficient pulling power to adequately accomplish pulling a stake from hardening concrete as required for this application.

Another object of this invention is to provide a stake puller with a ratchett like action having clamping jaws capable of taking a new bite into the stake being pulled with each lowering of the handle.

A further object of the invention is to provide a light weight sturdy tool for stake pulling having hardened steel jaws equipped with depth control structure to prevent bite-through when used to pull softer wooden stakes.

Many other objects and the advantages this invention will become more apparent from reading the following specification in consideration with the drawings and the numbered parts thereon.

SUMMARY OF THE INVENTION

In carrying out my invention, I have provided a stake puller for concrete form stakes with mechanics using the form top as a levering platform. A U-shaped levering head is affixed with angled form grippers at both ends of the opened U. At the closed end of the U, a levering arm is attached and a pliable handle grip fits over the unattached end. Suspended in the U by a hinge and hanger plate, is a sectional scissor structure with each section axially pinned together and having a small control handle centrally fitted. The two lower sectional leg bars have the tip ends angled outwards to form stake gripper toes as a means for grasping and pulling the stake. A depth control blockage is welded to the underside of the stake gripper toes to prevent stake bite-through.

To operate, the angled form grippers are positioned on the form top with the stake to be pulled between the legs of the U-shaped levering head. The stake gripper bars are opened to the stake width by movement of the control handle up or down which opens and closes the scissor size. When properly adjusted, an upward pull on the levering arm causes the lower stake grippers to be scissored together against the stake sides. An additional upward pull on the levering handle exerts leverage against the stake and pulls the stake upwards. The depth control blocks affixed to the underside of the stake grippers limits the bite-in to only that required to securely retain the stake. In a ratchett-like action, my stake puller takes a new bite with each lowering of the handle.

DESCRIPTION OF PREFERRED EMBODIMENTS

Figure 1:
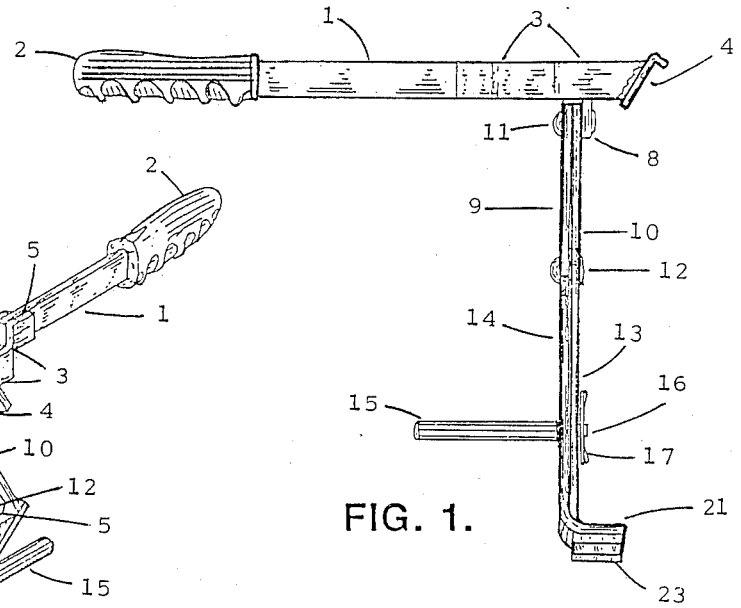
FIG. 1 shows my stake puller in a side view illustrating the horizontally positioned levering arm and U-shaped levering head in relationship to the vertically inclined scissor and jaw structure.
Figure 2:
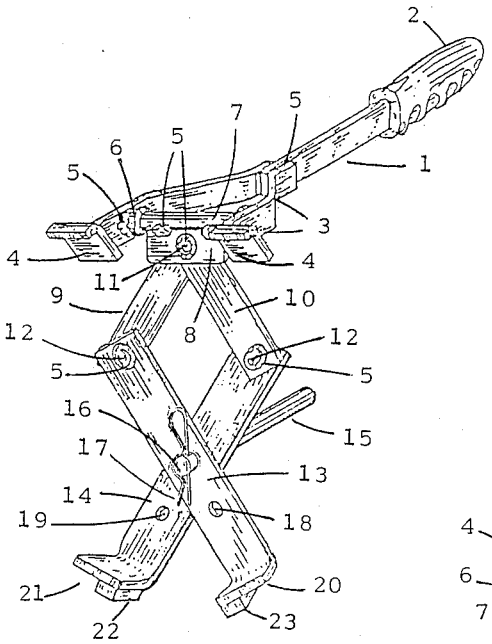
FIG. 2 is a perspective drawing of the stake puller.
Figure 3:
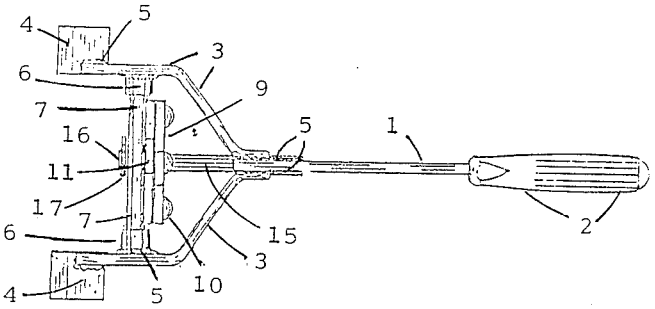
FIG. 3 shows a top plan view of my stake puller.
Figure 4:
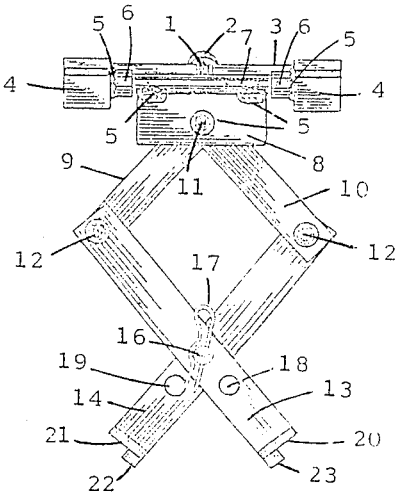
FIG. 4 is a frontal view of the stake puller showing the scissor arrangement on which the lower sections are angled as stake grippers with bite regulators under the gripper inner edges.
Figure 5:
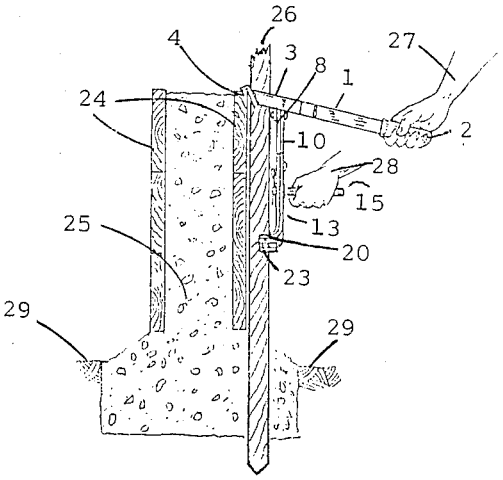
FIG. 5 is a drawing of my stake puller in use on a form stake being removed from hardening concrete.

Referring now to the drawings at FIG. 1 where levering arm 1 is covered at one end with pliable handle grip 2 and affixed at the other end with U-shaped levering head 3, the opened U ends of which are each fitted with inversed L-shaped form gripper 4 angularly attached. Levering arm 1 and U-shaped levering head 3 in horizontal operational position are opposed to the vertical inclination of top inner scissor bar 9 and top outer scissor bar 10, the upper ends of which are pivotally attached to U-shaped levering head 3 by scissor structure support bar 8 a part of hanger hinge 7. A forward and backward swing of the scissor structure is accomplished by trunnion end pins of hanger hinge 7 positioned in gudgeon supports 6. Latteral movement of top inner scissor bar 9 and top outer scissor bar 10 is accomplished through bar support axle pin 11 which retains the two upper bars pivotally affixed to scissor structure support bar 8. Scissor bar axle pins 12 allow movement of lower outer scissor bar 13 and lower inner scissor bar 14 to be transferred to top inner scissor bar 9 and top outer scissor bar 10 when scissor grip adjust handle 15 is moved in any direction. Adjust handle pivitol rod 16 axlly attaches lower outer scissor bar 13 and lower inner scissor bar 14 in a crossed position retained by handle pivotal rod retainer clip 17. The X intersection assemblage obtained opens a stake passage between outer bar angled stake gripper toes 20 and inner bar angled stake gripper toes 21. Adjusted to stake size by movement of handle 15, stake gripper toes 20 and 21 bite into the edges of stake 26, as illustrated in FIG. 5, when angled form grippers 4 rest on top of forms 24 and levering arm 1 is pulled upward by illustrative right hand 27 guided by illustrative left hand 26. Inner bar bite regulator 21 and outer bar bite regulator 22 allow stake grippers toes 20 and 21 to bite only to a depth in stake 26 sufficient to pull the stake from ground 29 and hardening concrete foundation 25.

In use, angled form grippers 4 are positioned on the top of a form 24 with the stake 26 inside U-shaped levering head 3 illustrated in FIG. 5. The user's right hand 27 usually holds levering arm 1 at handle grip 2 while user's left hand 28 is used to adjust the scissor structure to stake size which allows my stake puller to fit various sizes of wood and steel concrete forming stakes. An upward movement of levering arm 1 causes the gripper toes 20 and 21 to bite into stake 26 and further upward movement pulls the stake upwards. A ratchett-like action occurs in that the gripper toes 20 and 21 take a new bite each time levering arm 1 is lowered and pulled up again. In applications which might require lower outer scissor bar 13 and lower inner scissor bar 14 to be positioned differently, the handle pivotal rod retainer clip 17 can be removed and adjust handle pivotal rod 16 repositioned using outer bar adjust aperature 18 and inner bar adjust aperature 19 as a lower connecting point thus placing the scissor grip adjust handle 15 in a lowered position.

Although only one embodiment of my invention has been described in the specification and illustrated in the drawings, it is to be understood that modifications and variations thereof may be effected without departing from the scope of the invention as set forth in the appended claims.

I claim:

1. A form top levering stake puller for wooden and metal concrete form stakes comprising:

(a) an elongated rectangular arm as a levering arm covered at one end with a pliable handle grip (b) and affixed at the opposite end to a base of a U head in alignment with an opened U-head legs as an extension thereof;

(c) the end surfaces of the opened U-head legs affixed with inverse L-shaped members angularly positioned;

(d) a rod pivotally attached centrally between inner-facing surfaces of the U-head legs; said rod affixed with a flat rectangular plate aperture for single pivotal attachment to upper ends of two shore bars, said bars being the upper two bars of (e) a four-bar cross-levering scissor mechanism for vertical applications having the said two short upper bars pivotally affixed to two long lower bars, said lower bars being in a crossed scrissor arrangement pivotally attached by a pin in an end of a short handle, said short handle being an adjustment handle positioned to increase and decrease the opening between the extreme ends of two long bars when said ajustment handle is raised or lowered; said scissor mechanism functioning as a stake gripping device when the top ends of the short bars are lifted; said lower ends of the long scissor bars having (f) short right angled toes with opposing inner; surfaces affixed with (g) depth regulating bars thereunder, (h) said stake puller having arranged for horizontal positioning of the U head and arm extension affixed thereto as a levering arm and vertical positioning of the four-bar scissor mechanism with right angled toes of the lower bars useful as stke grippers when a force is aplied upwardly at the handle grip of said levering arm with said inverse L members on the U-head leg ends resting on top of a concrete construction form as a support; a scissor pin handle adjusting the scissor bar toe-end openings, (i) the handle and pin being repositionable into other cross-levering pin apertures in the lower long bars for increasing and decreasing opening sizes between opposing gripper faces.

2. The form top levering stake puller for wooden and metal concrete form stakes of claim 1 wherein, when said stake puller is positioned for use as described in claim 1 with a concrete construction form as a support, said scissor mechanics are arranged to grip a stake when upward pressure is applied at the levering arm handle grip and release the stake when the arm is lowered to produce a regripping and lifting action on the stake with each raising and lowering of the levering arm.

3. The form top levering stake puller for wooden and metal concrete from stake of claim 1 wherein, said depth regulating bars affixed under the short right angled toes are rectangular block extensions of the opposing inner surfaces of said gripper toes.

* * * * *

UNITED STATES PATENT AND TRADEMARK OFFICE

CERTIFICATE OF CORRECTION

PATENT NO. : 4,671,493

DATED : June 9, 1987

INVENTOR(S) : Gary N. Ravencroft

It is certified that error appears in the above-identified patent and that said Letters Patent is hereby corrected as shown below:

Column 2, line 61, "grippers" should read --gripper.

Column 3, line 36, "aperture" should read --apertured--.

Column 3, line 37, "shore" should read --short--.

Column 4, line 5, "ajustment" should read --adjustment--.

Column 4, line 10, ";" should read -- - --.

Column 4, line 13, "having" should read --being--.

Column 4, line 17, "stke" should read --stake--.

Column 4, line 18, "aplied" should read --applied--.

Signed and Sealed this

Seventeenth Day of May, 1988

*Attest:*

DONALD J. QUIGG

*Attesting Officer*

*Commissioner of Patents and Trademarks*